US009963933B2

(12) United States Patent
Chen

(10) Patent No.: US 9,963,933 B2
(45) Date of Patent: May 8, 2018

(54) BLIND BODY BRAKING MECHANISM FOR NON-CORD WINDOW BLIND ASSEMBLY

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days. days.

(21) Appl. No.: 14/942,339

(22) Filed: Nov. 16, 2015

(65) Prior Publication Data

US 2016/0265272 A1 Sep. 15, 2016

(30) Foreign Application Priority Data

Mar. 12, 2015 (TW) ..... 104107890 A

(51) Int. Cl.
*E06B 9/322* (2006.01)
*E06B 9/303* (2006.01)

(52) U.S. Cl.
CPC ..... *E06B 9/322* (2013.01); *E06B 9/303* (2013.01); *E06B 2009/3222* (2013.01)

(58) Field of Classification Search
CPC ..... E06B 9/322; E06B 3/38; E06B 2009/322; E06B 9/32; E06B 9/324; E06B 9/325; E06B 9/303
USPC ..... 160/170, 296
See application file for complete search history.

(56) References Cited

U.S. PATENT DOCUMENTS

| | | | | |
|---|---|---|---|---|
| 4,513,805 | A * | 4/1985 | Mase | E06B 9/80 160/299 |
| 6,443,210 | B1 * | 9/2002 | Welfonder | E06B 9/42 160/296 |
| 6,571,853 | B1 * | 6/2003 | Ciuca | E06B 9/60 160/170 |
| 8,051,960 | B2 * | 11/2011 | Nakajima | E06B 9/80 160/299 |
| 9,127,500 | B2 * | 9/2015 | Huang | E06B 9/322 |
| 9,410,599 | B2 * | 8/2016 | Yen | B60J 1/2033 |
| 9,482,049 | B2 * | 11/2016 | Chen | E06B 9/322 |
| 2003/0178276 | A1 * | 9/2003 | Fraczek | E06B 9/44 192/3.52 |
| 2004/0007333 | A1 * | 1/2004 | Militello | E06B 9/262 160/84.04 |
| 2006/0096719 | A1 * | 5/2006 | Wu | E06B 9/388 160/170 |
| 2010/0018655 | A1 * | 1/2010 | Nakajima | E06B 9/80 160/296 |
| 2014/0083631 | A1 * | 3/2014 | Huang | E06B 9/322 160/170 |

(Continued)

*Primary Examiner* — Blair M Johnson
(74) *Attorney, Agent, or Firm* — Muncy, Geissler, Olds & Lowe, P.C.

(57) ABSTRACT

A blind body braking mechanism used in a non-cord window blind assembly is disclosed to include two take-up wheels, two one-way clutch units respectively disposed adjacent to the two take-up wheels and respectively provide one clutch wheel, two guide rods respectively disposed at one lateral side relative to one respective take-up wheel in a parallel manner relative to the axis of the take-up wheels, and two transmission cords respectively extending over one respective guide rod and wound round one respective one-way clutch wheel with respective one end thereof fixedly connected to one respective one-way clutch wheel. Subject to the functioning of the guide rods, the transmission cords can be properly wound round the respective take-up wheels.

7 Claims, 7 Drawing Sheets

(56) References Cited

U.S. PATENT DOCUMENTS

2015/0211605 A1* 7/2015 Yen ..... B60J 1/2033
475/331

* cited by examiner

BLIND BODY BRAKING MECHANISM FOR NON-CORD WINDOW BLIND ASSEMBLY

BACKGROUND OF THE INVENTION

1. Field of the Invention

The present invention relates to window blind technology, and more particularly to a blind body braking mechanism for non-cord window blind assembly.

2. Description of the Related Art

In a non-cord window blind assembly, the transmission cord 1 has its one end fixedly connected to a respective take-up wheel 2 (see FIG. 1), and its other end inserted through the blind body and then affixed to the bottom rail. When pulling the bottom rail downward or pushing it upward, the transmission cord 1 is let off or rolled up subject to rotation of the respective take-up wheel 2, thereby extending out or receiving the blind body.

In order to maintain a certain tension during movement of the transmission cord 1, the transmission cord 1 is wound round a guide wheel through one turn. However, because the guide wheel can only provide a limited guiding effect, during rotation of the take-up wheel 2 to roll up the transmission cord 1, different turns of the transmission cord 1 been wound round the take-up wheel 2 can interfere with one another or be tangled together. If multiple turns of the transmission cord 1 been wound round the take-up wheel 2 are severely tangled, the transmission cord 1 can be prone to unsmooth movement or get stuck when it is being let off or rolled up, causing the blind body to be asymmetrically placed, or cannot be fully extended out or received. This will cause problems to the user.

SUMMARY OF THE INVENTION

The present invention has been accomplished under the circumstances in view. It is the main object of the present to provide a blind body braking mechanism for non-cord window blind assembly, which provides the blind body with excellent positioning effects and optimal actuation smoothness.

To achieve this and other objects of the present invention, a blind body braking mechanism for non-cord window blind assembly comprises a casing, a winding mechanism, two take-up wheels, two one-way clutch units, two guide rods, and two transmission cords. The winding mechanism is mounted in the casing. The two take-up wheels are rotatably mounted in the casing adjacent to the winding mechanism. The two one-way clutch units are respectively disposed adjacent to one respective take-up wheel, each comprising a one-way clutch wheel. The two guide rods are mounted in the casing, and respectively disposed at one lateral side relative to one respective take-up wheel in a parallel manner relative to the axis of each take-up wheel. The two transmission cords respectively are extended over one respective guide rod, and respectively wound round one respective one-way clutch wheel. Further, each transmission cord has one end thereof fixedly connected to one respective take-up wheel.

Thus, when the transmission cords are pulled out, the friction resistance created between the transmission cords and the respective one-way clutch wheels causes the respective one-way clutch wheels to rotate, enabling the blind body to be smoothly extended out. When the transmission cords are stopped from movement, the one-way clutch wheels are stopped from rotation, holding the blind body in position. When loosening the transmission cords to reduce the friction resistance between the transmission cords and the respective one-way clutch wheels, the take-up wheels are driven by the winding mechanism to roll up the respective transmission cords. At this time, the functioning of the guide rods enabling the transmission cords to be smoothly wound round the respective take-up wheels.

Other advantages and features of the present invention will be fully understood by reference to the following specification in conjunction with the accompanying drawings, in which like reference signs denote like components of structure.

DETAILED DESCRIPTION OF THE INVENTION

Figure 1:
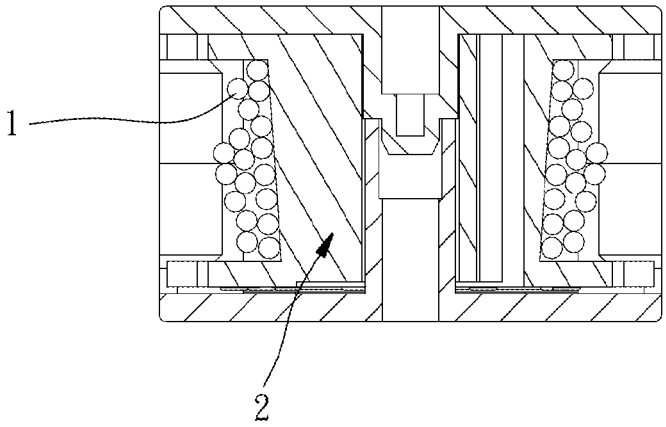
FIG. 1 PRIOR ART
FIG. 1 is a schematic sectional view illustrating a transmission cord wound round a take-up wheel according to the prior art.
Figure 2:
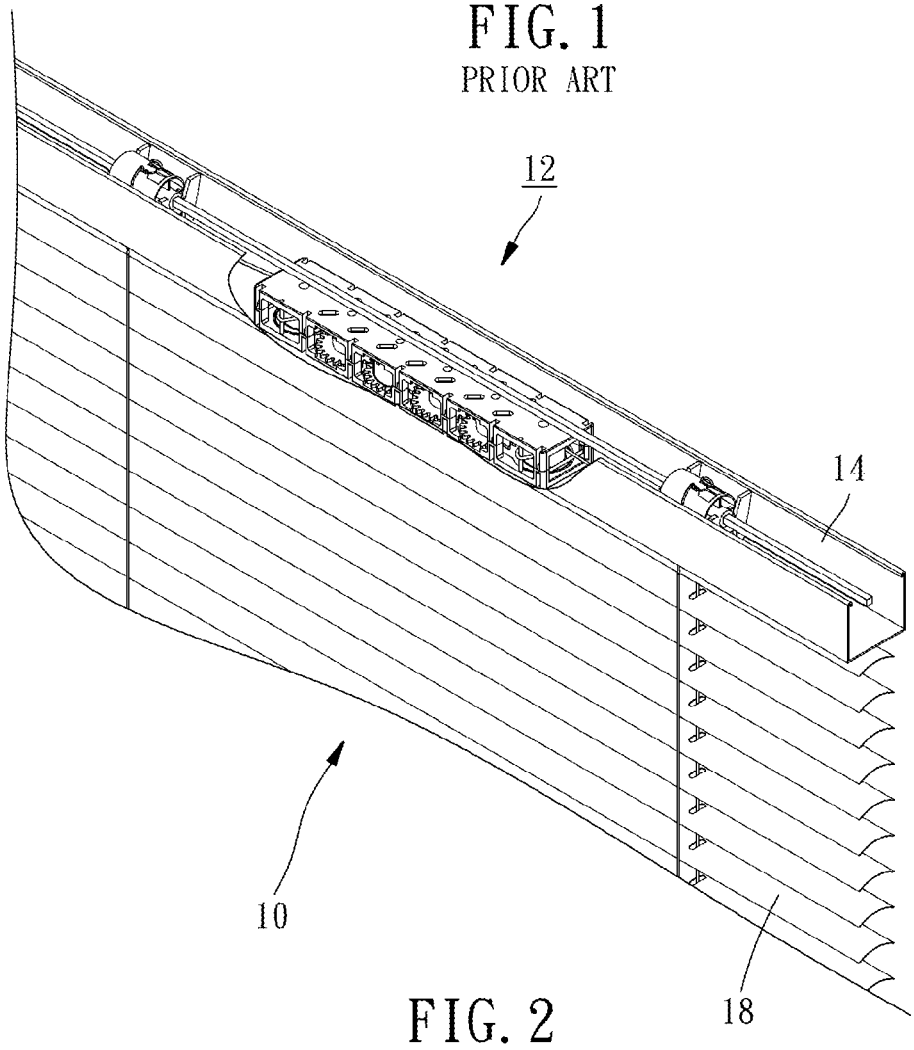
FIG. 2 is an oblique top elevational view illustrating a blind body braking mechanism installed in a non-cord window blind assembly in accordance with the present invention.
Figure 3:
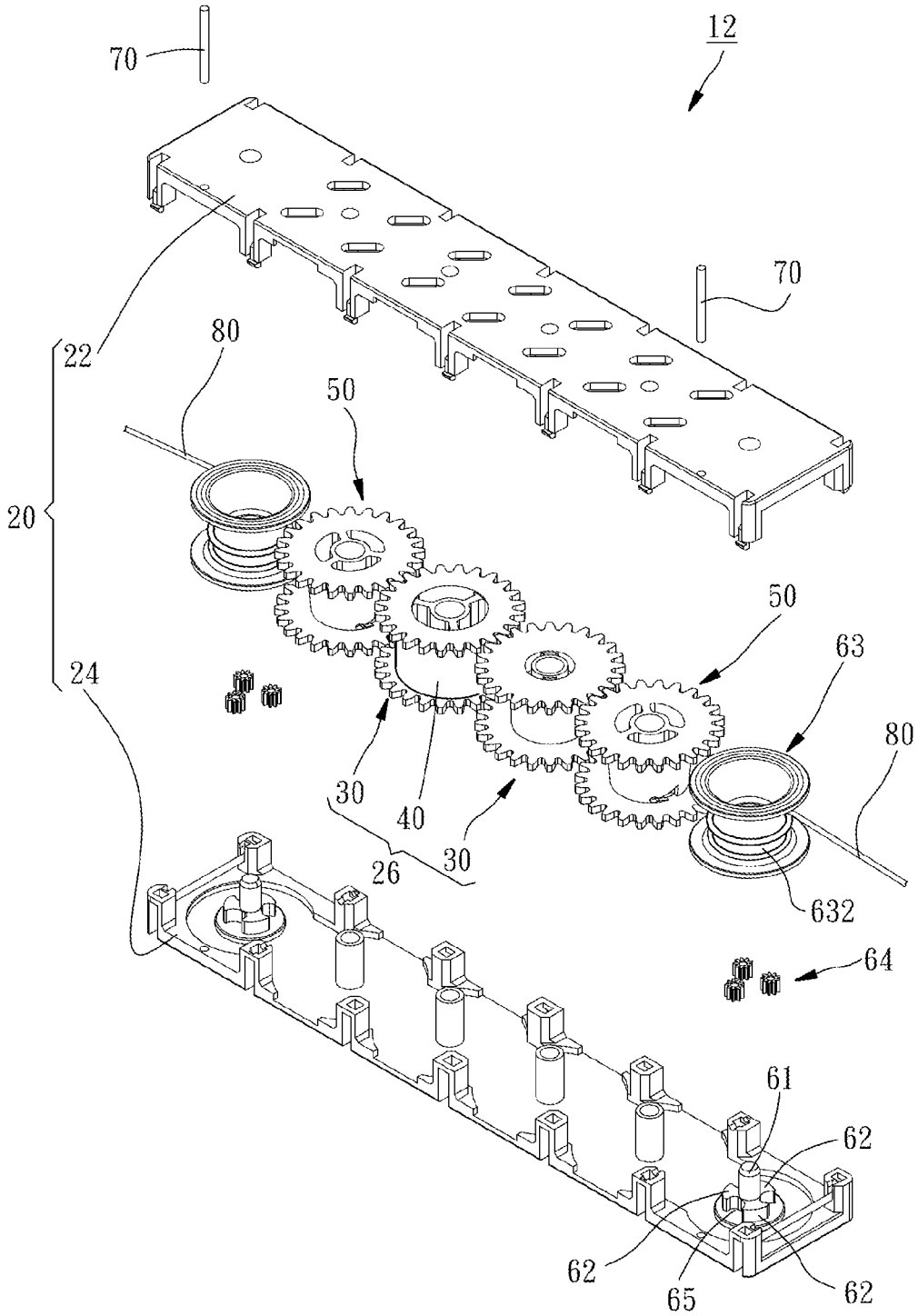
FIG. 3 is an exploded view of the blind body braking mechanism in accordance with the present invention.
Figure 4:
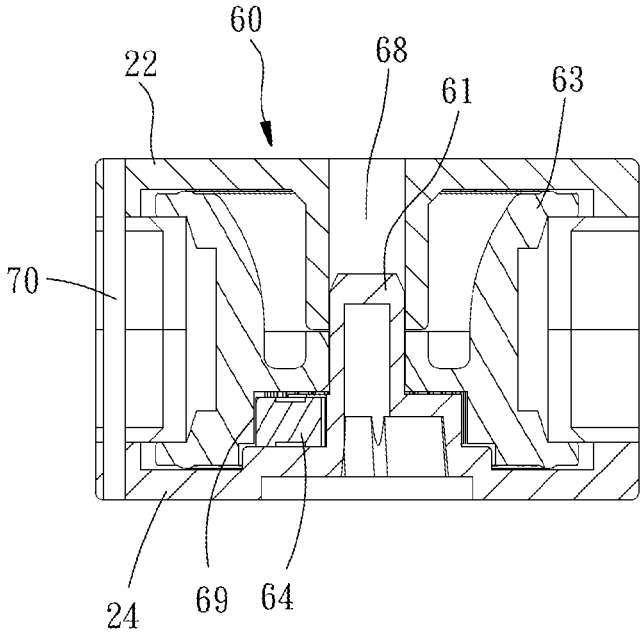
FIG. 4 is a sectional view of one one-way clutch unit of the blind body braking mechanism in accordance with the present invention.
Figure 8:
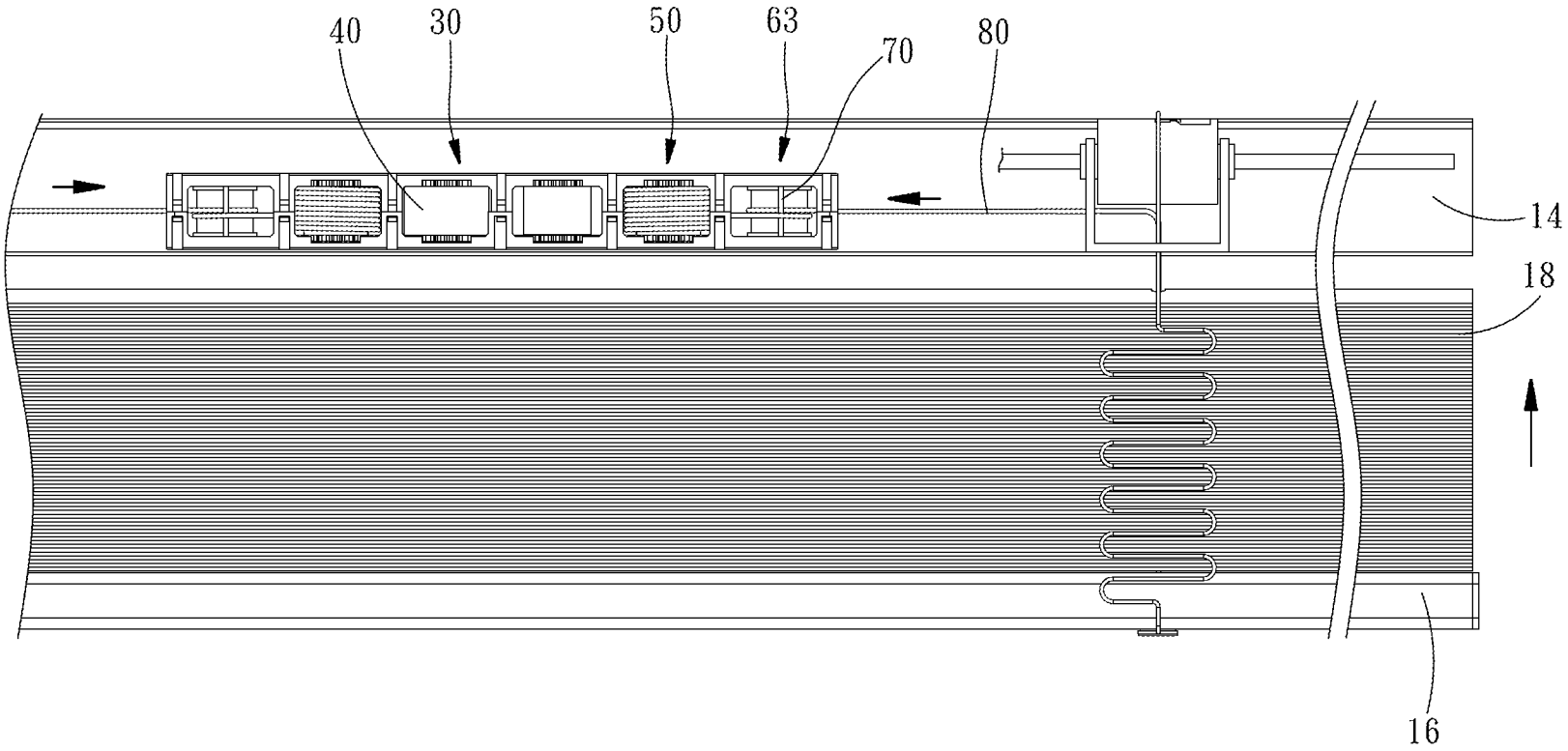
FIG. 8 is similar to FIG. 7, illustrating the blind body received.

Referring to FIGS. 2 and 8, a blind body braking mechanism 12 is shown used in a non-cord window blind assembly 10. As illustrated, the non-cord window blind assembly 10 comprises headrail 14, a bottom rail 16, and a blind body 18 coupled between the headrail 14 and the bottom rail 16. As illustrated in FIGS. 3 and 4, the blind body braking mechanism 12 comprises a casing 20, a winding mechanism 26, two take-up wheels 50, two one-way clutch units 60, two guide rods 70, and two transmission cords 80.

The casing 20 is mounted inside the headrail 14, comprising a top panel 22 and a bottom panel 24.

The winding mechanism 26 comprises two winding wheels 30, and a torsion spring 40. The two winding wheels 30 are rotatably mounted inside the casing 20 and meshed together. The torsion spring 40 has two opposite ends thereof respectively connected to the two winding wheels 30. Subject to the functioning of the torsion spring 40, the two winding wheels 30 can be rotated synchronously.

The take-up wheels 50 are rotatably mounted inside the casing 20 and respectively meshed with one respective winding wheel 30 so that each take-up wheel 50 is rotatable with the meshed winding wheel 30 synchronously.

Figure 5:
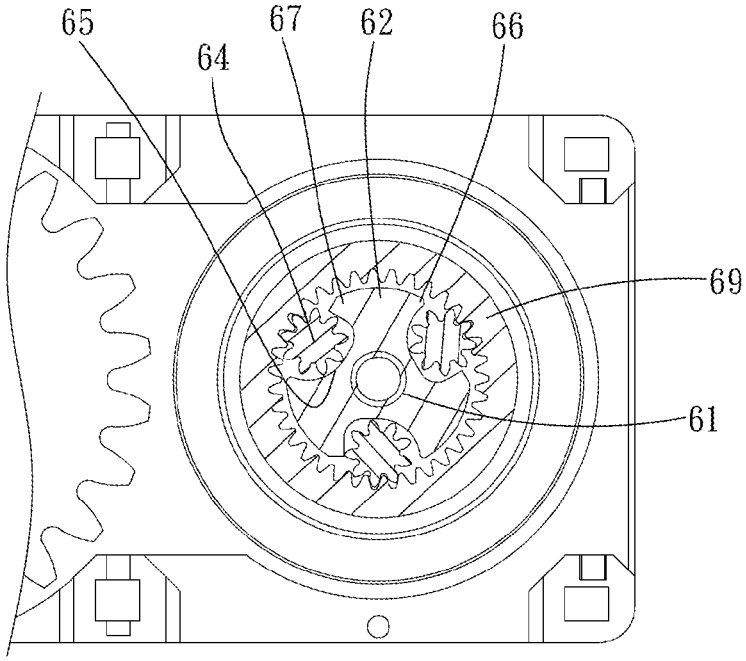
FIG. 5 is a schematic top view of one one-way clutch unit, illustrating the planetary gears forced into engagement with the brake portions of the respective brake blocks.
Figure 6:
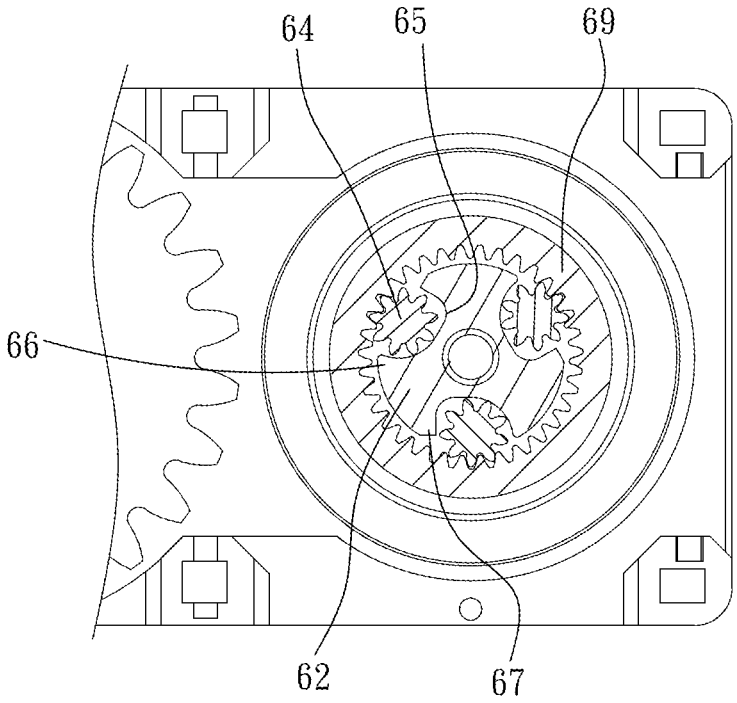
FIG. 6 is similar to FIG. 5, illustrating the planetary gears abutted against the bearing portions of the respective brake blocks.

The one-way clutch units 60 are respectively disposed adjacent to the take-up wheels 50, each comprising a wheel axle 61, three brake blocks 62, a one-way clutch wheel 63, and three planetary gears 64. The wheel axle 61 is affixed to the bottom panel 24 of the casing 20. The three brake block 62 are fixedly mounted at the bottom panel 24 of the casing 20 and equiangularly connected to the periphery of the wheel axle 61 so that an arched rolling groove 65 is defined between each two adjacent brake blocks 62. As illustrated in FIG. 5 and FIG. 6, the curvature of one end of the arched rolling groove 65 is larger than an opposite end of the arched rolling groove 65. Because the arched rolling groove 65 has the two opposite ends thereof respective abutted against different brake blocks 62, each brake block 62 has two opposite ends thereof respectively terminating in a brake portion 67 and a bearing portion 66 subject to a curvature difference between the two opposite ends of each arched rolling groove 65. The curvature of the brake portion 67 is larger than the curvature of the bearing portion 66. The one-way clutch wheel 63 comprises an axle hole 68, and an internal gear portion 69 adjacent to the axle hole 68. By means of the axle hole 68, the one-way clutch wheel 63 is coupled to the wheel axle 61. After coupled the one-way clutch wheel 63 to the wheel axle 61, the internal gear portion 69 extends around the brake blocks 62. Further, the one-way clutch wheel 63 comprises an equal-diameter body portion 632. The three planetary gears 64 are respectively rotatably mounted in the respective arched rolling grooves 65 and meshed with the internal gear portion 69 of the one-way clutch wheel 63, so that the planetary gears 64 can be driven by the internal gear portion 69 of the one-way clutch wheel 63 to rotate along the respective arched rolling grooves 65 upon rotation of the one-way clutch wheel 63.

The guide rods 70 are respectively disposed at one lateral side relative to one respective take-up wheel 50, each having opposing top and bottom ends thereof respectively fixedly fastened to the top panel 22 and bottom panel 24 of the casing 20 and kept in parallel to the axis of each take-up wheel 50.

The two transmission cords 80 have respective opposite ends thereof respectively fixedly connected to the bottom rail 16 and the respective take-up wheels 50 so that the two transmission cords 80 can be pulled out by the bottom rail 16, or rolled up by the respective take-up wheels 50. Further, the two transmission cords 80 are respectively extended over the respective guide rods 70, and respective wound around the equal-diameter body portions 632 of the respective one-way clutch wheels 63 through one turn, so that when the transmission cords 80 are being let off or rolled up, they can be moved back and forth along the axis of the respective guide rods 70 and the respective one-way clutch wheels 63, enhancing the agility and smoothness of the transmission cords 80.

Figure 7:
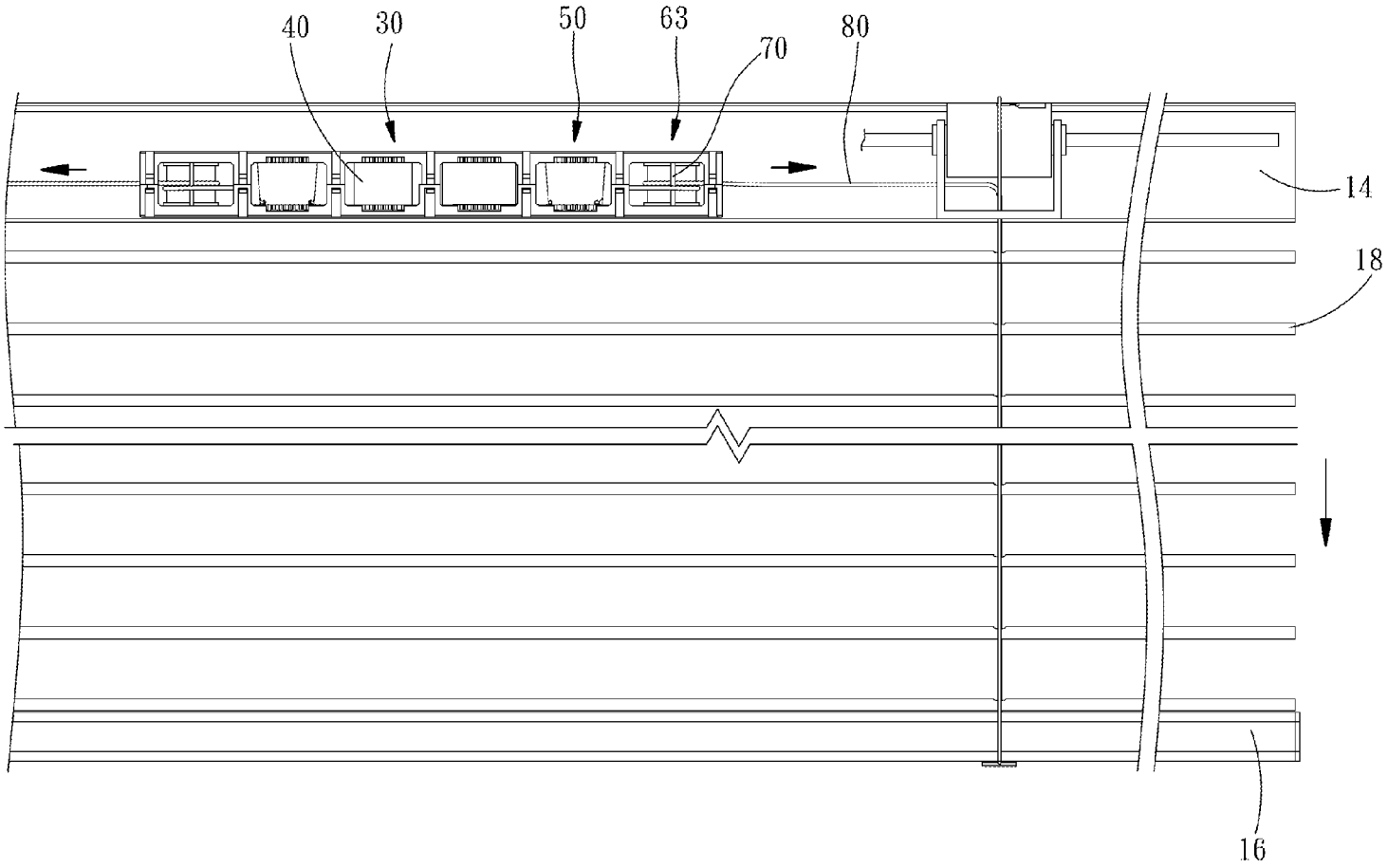
FIG. 7 is a front view of the non-cord window blind assembly in accordance with the present invention, illustrating the blind body extended out.

When wishing to extend out the blind body 18, as shown in FIG. 7, pull the bottom rail 16 downward to gradually extend out the transmission cords 80. When pulling out the transmission cords 80, the take-up wheels 50 are rotated, causing rotation of the meshed winding wheels 30. At this time, the torsion spring 40 is rolled up from one winding wheel 30 onto the other winding wheel 30 to store elastic potential energy. On the other hand, when the transmission cords 80 are being pulled out, a friction force is created between the transmission cords 80 and the respective one-way clutch wheels 63, causing the respective one-way clutch wheels 63 to be rotated. When the one-way clutch wheels 63 are rotated, as shown in FIG. 6, the internal gear portions 69 of the one-way clutch wheels 63 drive the respective planetary gears 64 to move along the respective arched rolling grooves 65 to the bearing portions 66 of the respective brake blocks 62. When reached the bearing portion 66 of the respective brake blocks 62, the planetary gears 64 are rotated in an idle manner, allowing the respective one-way clutch wheels 63 to be rotated freely, and thus the blind body 18 can be continuously extended out.

When the user releases the hand from the bottom rail 16 after the blind body 18 has been extended out to the desired position, the transmission cords 80 are stopped from being stretched. At this time, the winding wheels 30 are forced by the elastic potential energy of the torsion springs 40 to slightly reverse the respective take-up wheels 50. During this reverse rotation, the take-up wheels 50 roll up a respective small length of the respective transmission cords 80 to slightly reverse the respective one-way clutch wheels 63. During reverse rotation of the one-way clutch wheels 63, the internal gear portions 69 of the one-way clutch wheels 63 drive the respective planetary gears 64 to move along the respective arched rolling grooves 65 into engagement with the brake portions 67 of the respective brake blocks 62, as shown in FIG. 5, and thus, the planetary gears 64 and the respective one-way clutch wheels 63 are stopped from rotation. After the respective one-way clutch wheels 63 are stopped from rotation, subject to the effect of the friction resistance between the transmission cords 80 and the respective one-way clutch wheels 63 and the effect of the gravity weight of the bottom rail 16, the transmission cords 80 and the elastic potential energy of the torsion spring 40 exhibit static balance, holding the blind body 16 in position.

Figure 9:
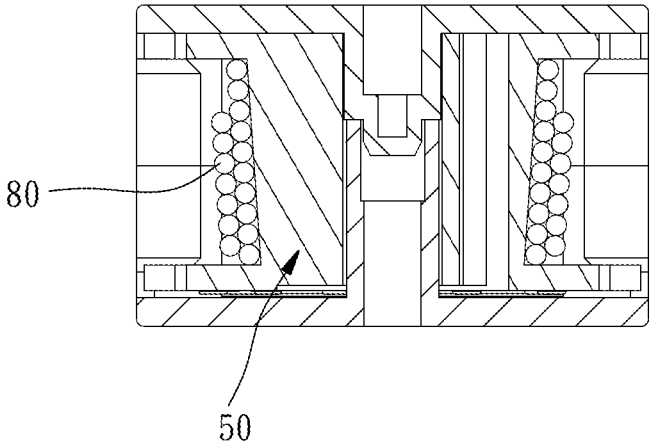
FIG. 9 is a sectional view of a part of the present invention, illustrating the transmission cord rolled up on the respective take-up wheel.

When wishing to receive the blind body 16, as shown in FIG. 8, push the bottom rail 16 upward to loosen the transmission cords 80 and to reduce the friction between the transmission cords 80 and the respective one-way clutch wheels 63. At this time, the elastic potential energy of the torsion spring 40 works with the user's push force to cause the winding wheels 30 to rotate. During rotation of the winding wheels 30, the take-up wheels 50 are rotated by the respective winding wheels 30 to roll up the respective transmission cords 80. When the transmission cords 80 are being rolled up by the respective take-up wheels 50, the transmission cords 80 are properly wound round the respective take-up wheels 50 subject to the guiding effects of the respective guide rods 70 (see FIG. 9), preventing interference and avoiding tangled transmission cords. Thus, the transmission cords 80 can be smoothly extended out in a next stretching operation. When the user releases the hand from the bottom rail 16 after the blind body 18 reached the desired position in the receiving operation, the transmission cords 80 are firmly wound round the respective one-way clutch wheels 63 again. At this time, the transmission cords 80 and the elastic potential energy of the torsion spring 40 exhibit static balance subject to the effect of the friction resistance between the transmission cords 80 and the respective one-way clutch wheels 63 and the effect of the gravity weight of the bottom rail 16, and thus, the blind body 16 is positively held in position.

Figure 10:
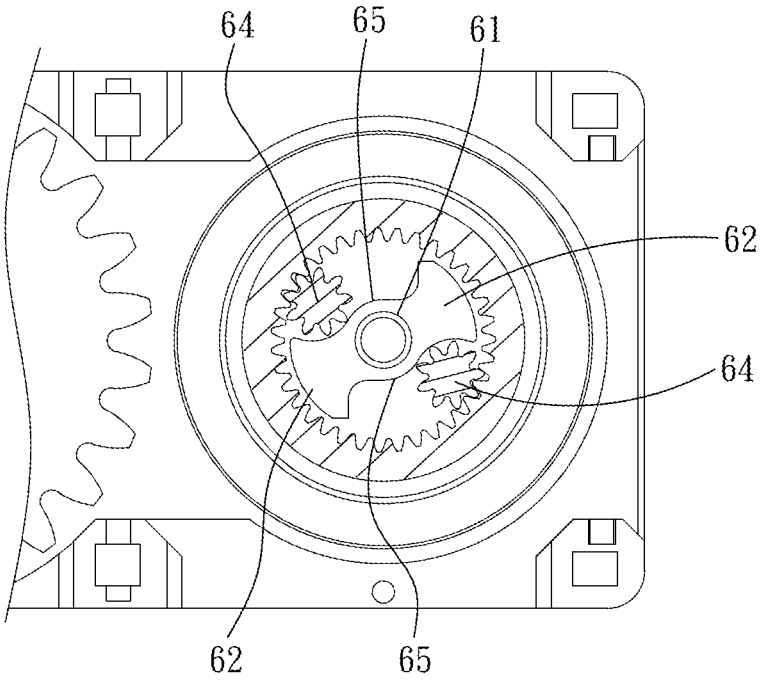
FIG. 10 is a sectional top view of one one-way clutch unit in accordance with a second embodiment of the present invention.

It's worth mentioning that the structure of the invention can be variously embodied. For example, as shown in FIG. 10, the number of the brake blocks 62 is not limited to three, in actual application, the number of the brake blocks 62 can be two. In this case, the two brake blocks 62 are connected to the periphery of the wheel axle 61 and disposed opposite to each other, and thus, an arched rolling groove 65 is defined between each end of each of the two brake blocks 62 for accommodating one respective planetary gear 64. Thus, when the one-way clutch wheels 63 are driven by the respective transmission cords 80, the planetary gears 64 are driven to move along the respective arched rolling grooves 65, creating clutch effects between the planetary gears 64 and the respective brake blocks 62.

In conclusion, the blind body braking mechanism 12 uses the one-way clutch units 60 to control the motion of the respective transmission cords 80, providing an optimal braking effect during the process the blind body 18 is extended out or received, and also uses the guide rods 70 to guide movement of the respective transmission cords 80, enabling the transmission cords 80 to be smoothly and neatly rolled up to further let the blind body 18 to be steadily extended or received.

What is claimed is:

1. A blind body braking mechanism for a non-pull cord window blind assembly, comprising:

a casing;

a winding mechanism mounted in said casing;

two take-up wheels rotatably mounted in said casing adjacent to said winding mechanism;

two one-way clutch units respectively disposed adjacent to one respective said take-up wheel, each said one-way clutch unit comprising a one-way clutch wheel, and a wheel axle fixedly mounted in said casing;

two guide rods mounted in said casing and respectively disposed at one lateral side relative to one respective said take-up wheel, each of said guide rods having an axis thereof parallel to an axis of each said take-up wheel and said wheel axle of each said one-way clutch unit; and two transmission cords respectively extending over one respective said guide rod in a way that said two transmission cords are always in contact with said two guide rods respectively while said transmission cords are rolled up and pulled down, and respectively wound round one respective said one-way clutch wheel, each said transmission cord having one end thereof fixedly connected to one respective said take-up wheel;

wherein each said one-way clutch unit further comprises at least two brake blocks fixedly mounted in said casing and equiangularly connected to the periphery of said wheel axle, a rolling groove defined between each two adjacent said brake blocks, and at least two planetary gears respectively rotatably mounted in one respective said rolling groove; each said one-way clutch wheel comprises an axle hole, and an internal gear portion located adjacent to said axle hole, each said one-way clutch wheel being rotatably coupled to said wheel axle through said axle hole, said internal gear portion being located around said at least two brake blocks and meshed with said planetary gears for moving each said planetary gear into engagement with one respective said brake block or away from the respective said brake block upon rotation of said internal gear portion in one of two reversed directions.

2. The blind body braking mechanism for the non-pull cord window blind assembly as claimed in claim 1, wherein said winding mechanism comprises two winding wheels and one torsion spring, said winding wheels being rotatably mounted in said casing and meshed together, said torsion spring being connected between said two winding wheels and alternatively wound round one said winding wheel; each said take-up wheel is meshed with one respective said winding wheel.

3. The blind body braking mechanism for the non-pull cord window blind assembly as claimed in claim 1, wherein each said one-way clutch wheel comprises an equal-diameter body portion; each said transmission cord is wound round said equal-diameter body portion of one respective said one-way clutch wheel.

4. The blind body braking mechanism for the non-pull cord window blind assembly as claimed in claim 1, wherein each said rolling groove is arch-shaped.

5. The blind body braking mechanism for the non-pull cord window blind assembly as claimed in claim 4, wherein the curvature of one end of each said rolling groove is larger than the curvature of an opposite end thereof so that each said brake block has a brake portion and a bearing portion respectively formed on two opposite ends thereof, the curvature of said brake portion being larger than the curvature of said bearing portion; when each said planetary gear is forced into engagement with said brake portion of the respective said brake block, each said one-way clutch wheel is prohibited from rotation; when each said planetary gear is forced into abutment against said bearing portion of the respective said brake block, each said one-way clutch wheel is freely rotatable.

6. The blind body braking mechanism for the non-pull cord window blind assembly as claimed in claim 1, wherein the number of said at least two brake blocks of each said one-way clutch unit is two, and the two said brake blocks of each said one-way clutch unit are disposed at two opposite sides relative to said wheel axle.

7. The blind body braking mechanism for the non-pull cord window blind assembly as claimed in claim 1, wherein the number of said at least two brake blocks of each said one-way clutch unit is three, and the three said brake blocks of each said one-way clutch unit are equiangularly spaced around said wheel axle so that one said rolling groove is defined between each two adjacent said brake blocks.

* * * * *